United States Patent [19]

Watson

[11] Patent Number: 4,709,492

[45] Date of Patent: Dec. 1, 1987

[54] PUSHING APPARATUS, AND METHODS OF CONSTRUCTING AND UTILIZING SAME

[76] Inventor: Gordon Watson, 12750 Apple Dr., Nunica, Mich. 49448

[21] Appl. No.: 884,001

[22] Filed: Jul. 10, 1986

[51] Int. Cl.[4] ..... E01H 5/04

[52] U.S. Cl. ..... 37/232; 37/270; 37/274; 172/815; 172/727; 172/728; 172/748

[58] Field of Search ..... 37/232, 233, 266, 267, 37/270, 271, 279, 281, 282, DIG. 3, 117.5; 172/815, 727–728, 748; 414/703, 712, 912

[56] References Cited

U.S. PATENT DOCUMENTS

| | | | |
|---|---|---|---|
| 1,728,032 | 9/1929 | Bising | 37/232 |
| 1,925,397 | 9/1933 | Meyer | 37/270 |
| 2,061,585 | 11/1936 | Meyer | 37/270 |
| 2,433,019 | 12/1947 | Arps | 37/117.5 |
| 2,816,375 | 12/1957 | Anderson | 172/811 |
| 2,899,760 | 8/1959 | Armington et al. | 37/2 R |
| 2,936,537 | 5/1960 | Bain | 37/233 |
| 3,477,149 | 11/1969 | Wagner | 37/233 |
| 3,793,752 | 2/1974 | Snyder | 37/233 |
| 4,259,794 | 4/1981 | Rath | 37/233 |

FOREIGN PATENT DOCUMENTS

| | | | |
|---|---|---|---|
| 141526 | 8/1953 | Sweden | 37/271 |
| 247122 | 11/1969 | U.S.S.R. | 172/815 |

*Primary Examiner*—E. H. Eickholt

*Attorney, Agent, or Firm*—Irving M. Weiner; Joseph P. Carrier; Pamela S. Burt

[57] ABSTRACT

A device for back scraping snow, earth, or other like substances which generally includes a truck having a concave snowplow blade mounted on its front. The blade has shoes provided on its backside, wedge shaped hinged connections mounted on the shoes, and a flat blade mounted pivotably on said wedge brackets. When the flat blade is brought in contact with snow to be scraped and the snowplow blade is moved in a backwardly direction, the snow to be scraped is moved by the flat blade.

20 Claims, 4 Drawing Figures

PUSHING APPARATUS, AND METHODS OF CONSTRUCTING AND UTILIZING SAME

BACKGROUND OF THE INVENTION

1. Field of the Invention

The present invention relates generally to pushing apparatus and snowplowing, and the blades mounted on trucks that are used to perform this task. More specifically, this invention relates to a back scraper which attaches to the back of a snowplow blade which generally goes on the front of a truck.

2. Description of Relevant Art

The relevant art is exemplified by Arps U.S. Pat. No. 2,433,019; Anderson U.S. Pat. No. 2,816,375; and Armington et al U.S. Pat. No. 2,899,760.

Previous attempts to build back scraping devices have resulted in complicated constructions and vehicles having a high likelihood of breaking down, and not being easily useable or adaptable to common trucks. No previous attempted solution to the problem of back scraping snow and/or ice has resulted in an uncomplicated structure which adapts to the snowplow blade on the front of a truck without any alterations being made in the blade or truck whatsoever.

SUMMARY OF THE INVENTION

The present invention generally solves the inadequacies of the previous attempts to develop a cheap viable back scraper blade. In general it accomplishes this by attaching to the shoes on a conventional truck snowplow blade a hinge having welded thereon a portion which hangs down which has welded on it a wedge, and a back scraper blade which attaches to the hinge and rests on said wedge. A portion of the back scraper blade extends down below the wedge. Thus, when the back scraper blade is used, i.e., when the vehicle backs up it digs into the snow, and when it is not used it will ride upon the wedge or the snow.

It is an object of the present invention disclosure to provide an economical, easily installed back scraper to be used in combination with the common snowplow blade which may be provided on a common 4-wheel type truck.

It is a further object of the present invention disclosure to provide a back scraper blade which may be easily and quickly installed upon the shoes of a snowplow blade.

DETAILED DESCRIPTION OF PREFERRED EMBODIMENT

Figure 1:
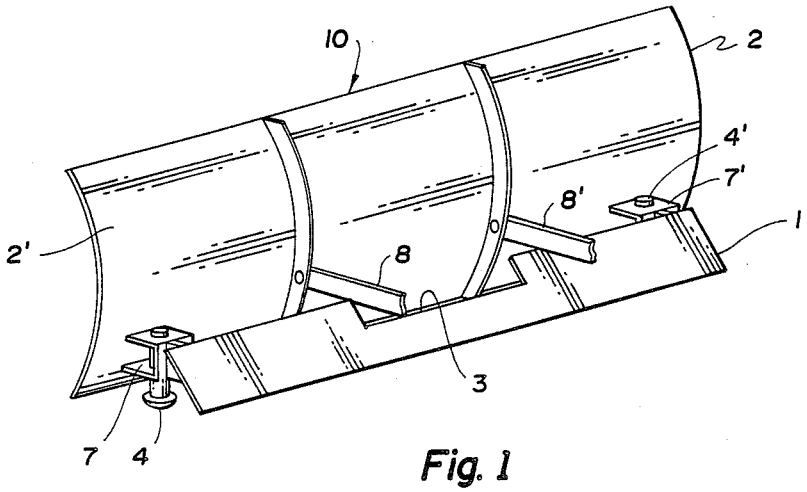
FIG. 1 represents a rear elevational view of a snowplow blade having a back scraper blade attached thereto. As may be noted there are protruding arm-like extensions off the back of the snowplow blade which may be attached to a motorized vehicle or a hydraulic hoist mounted on a motorized vehicle.

FIG. 1 shows the invention 10 which includes a concave snowplow blade having shoes 7,7′ disposed on its backside 2′.

As can be seen, shoes 7,7′ have apertures in their top and bottom sides. In order to install the back scraper blade 1, wedge brackets 5 and 5′ (one not being shown) have at least one aperture in their top side which is aligned with the aperture in shoes 7,7′ when placed over the shoes 7,7′. Wedge brackets 5,5′ (one not being shown) are fixedly attached to the shoes 7,7′ by use of snap pins 4,4′ which are secured in position by a cotter pin or the like (not shown).

Figure 2:
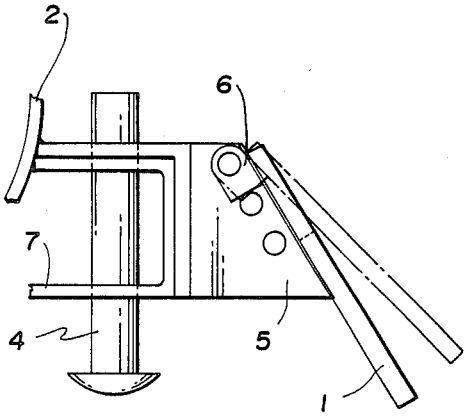
FIG. 2 shows a side elevational view of the invention with the snowplow blade partially cut away and the bracket and hinge coupling to the back scraper blade enlarged.

The wedge brackets 5,5′ have a downwardly sloping edge (as best seen in FIG. 2) which extends outwardly from the backside 2′ of snowplow blade 2. This sloping edge is clearly shown in FIG. 2 and has defined in it several transverse apertures.

Hinges 6 and 6′ (the latter not being shown) are disposed on the backside of back scraper blade 1 and have transverse apertures therein to be aligned with said apertures on the downwardly sloping edge of wedge brackets 5,5′. Hinges 6,6′ are pivotally attached to wedge brackets 5,5′. Furthermore, hinges 6,6′ are fixedly attached to back scraper blade 1, such that, when the back scraper blade 1 is moved, hinges 6,6′ undergo pivotal movement relative to wedge brackets 5,5′.

Figure 3:
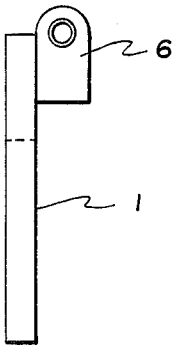
FIG. 3 shows the back scraper blade having a hinge attached to the upper portion thereof.
Figure 4:
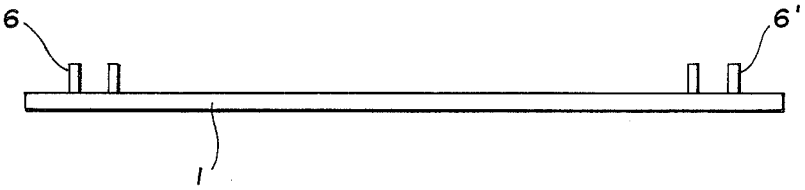
FIG. 4 is a top view of the back scraper blade showing that there are two members to each hinged connection thereon.

An enlarged view of the hinge 6 and the back scraper blade 1 is found in FIG. 3. It should be noted that it is contemplated that back scraper blade 1 preferably, but not necessarily, be made of two different substances, preferably metals having different rates of wear. The lower portion of back scraper blade 1 is contemplated to be made out of a substance having a resistance to wear giving it an estimated useful life of about 2 years whereas the upper portion of said blade will be of a harder more wear-resistant material. This will generally permit back scraper blade 1 to be able to give as necessary when it meets resistance while engaged in the task of back scraping.

As can be seen from the construction of the back scraper blade 1, it may be mounted on the backside 2′ of an ordinary snowplow blade 2 which goes on the front of the truck. Snowplow blade 2 is generally connected to the front of the truck by arms 8,8′ which generally are attached to a hydraulic hoist (not shown) mounted on the front of the truck. In order to minimize any need for altering snowplow blade, a cutout 3 has been provided on back scraper blade 1 so that it will not interfere with arms 8,8′. Generally, it is believed that the back scraper blade 1 and its accessories e.g., wedge brackets 5,5′ and snap pins 4,4′, may be installed upon snow plowblade 2 without its removal from a motorized vehicle upon which it is installed.

The combination invention 10 may be used by the operator of the snowplow truck by: actuating the hydraulic hoist (not shown) lifting snowplow blade 2 above the snow; moving the snowplow truck to a desired position; dropping the snowplow blade 2 to a level where back scraper blade 1 comes into contact with the surface beneath the snow; and then backing up said snowplow truck and scraping the surface clean. As can be seen invention 10 can be used not only for back scraping snow and ice off driveways or other areas where the snow and/or ice cannot be pushed forward, but also for back scraping earth or other materials.

Although the described preferred embodiments envision use of a truck, tractor, or other vehicle, the present invention also embraces other pushing apparatus which may be hand-held, e.g., a shovel-like device.

It is to be understood that the present invention 10 is not to be limited to the single preferred embodiment disclosed above. It is further contemplated that invention 10 will be better understood by reference to the appended claims.

I claim:

1. A pushing apparatus, comprising, in combination:

a main blade for pushing a portion of a substance when said main blade is moved in a forward direction;

a back scraper blade for pushing another portion of said substance when said main blade is moved in a rearward direction;

connecting means for operably and hingedly connecting said back scraper blade to the rear of said main blade; and said connecting means comprising shoes disposed on the backside of said main blade and wedge brackets fitted over said shoes for hingedly holding said back scraper blade.

2. An apparatus according to claim 1, including:

elevation means operably connected to said main blade, said back scraper blade, and said connecting means for selectively raising and lowering said main blade, said back scraper blade and said connecting means in unison en masse.

3. An apparatus according to claim 1, wherein:

said main blade, said back scraper blade, and said connecting means are operably connected to the front portion of a vehicle.

4. A pushing apparatus, comprising, in combination:

a main blade for pushing a portion of a substance when said main blade is moved in a forward direction;

a back scraper blade for pushing another portion of said substance when said main blade is moved in a rearward direction;

connecting means for operably and hingedly connecting said back scraper blade to the rear of said main blade;

elevation means operably connected to said main blade, said back scraper blade, and said connecting means for selectively raising and lowering said main blade, said back scraper blade and said connecting means in unison en masse; and said main blade, said back scraper blade, and said connecting means operably connected to the front portion of a vehicle.

5. A pushing apparatus, comprising, in combination:

a main blade for pushing a portion of a substance when said main blade is moved in a forward direction;

a back scraper blade for pushing another portion of said substance when said main blade is moved in a rearward direction;

connecting means for operably and hingedly connecting said back scraper blade to the rear of said main blade;

shoes disposed on the rear side of said main blade;

wedge brackets which fit over said shoes;

selectively-releasable fastening means which operably fix said shoes and said wedge brackets together;

said wedge brackets having a downwardly sloping side having transverse apertures defined therein;

hinges pivotally attached to said wedge brackets;

said back scraper blade being connected to said hinges; and said back scraper blade resting on said downwardly sloping side of said wedge brackets.

6. A pushing apparatus, comprising, in combination:

a main blade for pushing a portion of a substance when said main blade is moved in a forward direction;

a back scraper blade for pushing another portion of said substance when said main blade is moved in a rearward direction;

connecting means for operably and hingedly connecting said back scraper blade to the rear of said main blade;

elevation means operably connected to said main blade, said back scraper blade, and said connecting means for selectively raising and lowering said main blade, said back scraper blade and said connecting means in unison en masse;

shoes disposed on the rear side of said main blade;

wedge brackets which fit over said shoes;

selectively-releasable fastening means which operably fix said shoes and said wedge brackets together;

said wedge brackets having a downwardly sloping side having transverse apertures defined therein;

hinges pivotally attached to said wedge brackets;

said back scraper blade being connected to said hinges; and said back scraper blade resting on said downwardly sloping side of said wedge brackets.

7. A pushing apparatus, comprising, in combination:

a main blade for pushing a portion of a substance when said main blade is moved in a forward direction;

a back scraper blade for pushing another portion of said substance when said main blade is moved in a rearward direction;

connecting means for operably and hingedly connecting said back scraper blade to the rear of said main blade;

said main blade, said back scraper blade, and said connecting means are operably connected to the front portion of a vehicle;

shoes disposed on the rear side of said main blade;

wedge brackets which fit over said shoes;

selectively-releasable fastening means which operably fix said shoes and said wedge brackets together;

said wedge brackets having a downwardly sloping side having transverse apertures defined therein;

hinges pivotally attached to said wedge brackets;

said back scraper blade being connected to said hinges; and said back scraper blade resting on said downwardly sloping side of said wedge brackets.

8. An apparatus according to claim 4, including:

shoes disposed on the rear side of said main blade;

wedge brackets which fit over said shoes;

selectively-releasable fastening means which operably fix said shoes and said wedge brackets together;

said wedge brackets having a downwardly sloping side having transverse apertures defined therein;

hinges pivotally attached to said wedge brackets;

said back scraper blade being connected to said hinges; and said back scraper blade resting on said downwardly sloping side of said wedge brackets.

9. An apparatus according to claim 1, wherein:

said back scraper blade has a metallic lower portion which has a lower resistance to wear compared to the upper portion of said back scraper blade.

10. An apparatus according to claim 2, wherein:

said back scraper blade has a metallic lower portion which has a lower resistance to wear compared to the upper portion of said back scraper blade.

11. An apparatus according to claim 3, wherein:

said back scraper blade has a metallic lower portion which has a lower resistance to wear compared to the upper portion of said back scraper blade.

12. An apparatus according to claim 4, wherein:

said back scraper blade has a lower portion which has a lower resistance to wear compared to the upper portion of said back scraper blade.

13. A back scraping device, comprising, in combination:

a concave snowplow blade;

shoes disposed on the backside of said snowplow blade;

wedge brackets which fit over said shoes;

snap pins which operably fix said shoes and wedge brackets together;

said wedge brackets having a downwardly sloping side having transverse apertures defined therein;

hinges which pivotally attach to said apertures in said wedge brackets; and a back scraper blade fixedly attached to said hinges;

said back scraper blade rests on said downwardly sloping side of said wedge brackets.

14. The back scraping device of claim 8, wherein:

said back scraper blade has an aperture cut out of the midportion of said back scraper blade.

15. The back scraping device of claim 14, wherein:

said snowplow blade is provided with arms thereon for attachment to a motorized vehicle.

16. The back scraping device of claim 15, wherein:

said back scraper blade has a lower portion which has a lower resistance to wear compared to the upper portion of said back scraper blade.

17. The back scraping device of claim 16, wherein:

said back scraper blade is welded to said hinge.

18. The back scraping device of claim 17, wherein:

said number of shoes equal said number of wedge brackets equal said number of snap pins which equals the number of hinges on said back scraper blade.

19. The back scraping device of claim 17, wherein:

at least two of said shoes are employed:

at least two of said wedge brackets are employed;

at least two of said snap pins are employed; and at least two of said hinges are employed.

20. The method of using the back scraping device of claim 9, comprising:

lifting said concave snowplow blade over a predetermined area to be back scraped;

bringing said concave snowplow blade downward toward the surface to be back scraped until said back scraper blade is in contact therewith;

and moving said concave snowplow blade and said back scraper blade backwardly to a predetermined position.

* * * * *

UNITED STATES PATENT AND TRADEMARK OFFICE

CERTIFICATE OF CORRECTION

PATENT NO. : 4,709,492

DATED : December 1, 1987

INVENTOR(S) : Gordon WATSON

It is certified that error appears in the above-identified patent and that said Letters Patent is hereby corrected as shown below:

Column 2, line 5, after "blade" insert --2--;
line 52, after "blade" insert --2--;
lines 56-57, change "snow plowblade" to --snowplow blade--.
Column 3, line 53 (claim 4, line 17), after "means" insert --are--.
Column 6, line 3 (claim 14, line 1), change "8" to --13--;
line 26 (claim 20, line 2), change "9" to --13--.

Signed and Sealed this

Twenty-first Day of February, 1989

*Attest:*

DONALD J. QUIGG

*Attesting Officer*

*Commissioner of Patents and Trademarks*